US005400049A

United States Patent [19]

Yoshii

[11] Patent Number: 5,400,049

[45] Date of Patent: Mar. 21, 1995

[54] DISPLAY CONTROL DEVICE WITH COMPENSATION FOR ROUNDED OR RINGING WAVEFORMS

[75] Inventor: Masaharu Yoshii, Shiki, Japan

[73] Assignee: Sharp Kabushiki Kaisha, Osaka, Japan

[21] Appl. No.: 255,894

[22] Filed: Jun. 7, 1994

Related U.S. Application Data

[63] Continuation of Ser. No. 961,037, Oct. 14, 1992, abandoned, Continuation of Ser. No. 594,162, Oct. 9, 1990, abandoned.

[30] Foreign Application Priority Data

Oct. 16, 1989 [JP] Japan ..... 1-268556

[51] Int. Cl.[6] ..... G09G 3/36

[52] U.S. Cl. ..... 345/97; 345/94

[58] Field of Search ..... 340/784, 805, 765, 793; 350/333, 332; 359/55, 85, 54, 56; 345/87, 94, 97, 92

[56] References Cited

U.S. PATENT DOCUMENTS 4,872,059 10/1989 Shinabe ..... 358/241
5,010,326 4/1991 Yamazaki et al. ..... 340/765

FOREIGN PATENT DOCUMENTS 0 322 022 A1 6/1989 European Pat. Off. .
0102230 5/1987 Japan .

*Primary Examiner*—Alvin E. Oberley
*Assistant Examiner*—Chanh Nguyen
*Attorney, Agent, or Firm*—Nixon & Vanderhye

[57] ABSTRACT

A display control device for a dot-matrix type liquid-crystal display device with a plurality of common electrodes and data electrodes including a common electrode driver for successively applying a scan pulse to the common electrodes, and a data electrode driver for applying data signals each having black level or white level to the data electrodes. The data electrode drive is adapted to set each of the data signals to one of the black level and white level during a predetermined period of time immediately before the leading and trailing edges of the scan pulse and to the other of the black level and white level during a predetermined period of time immediately after the leading and trailing edges of the scan pulse.

13 Claims, 9 Drawing Sheets

Fig. 2 (A) LIQUID CRYSTAL ALTERNATING SIGNAL
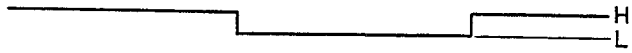
Fig. 2 (B) DRIVING SIGNAL FOR i TH ROW COMMON ELECTRODE
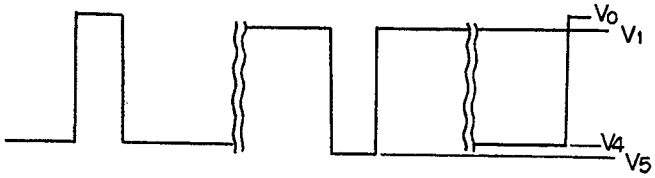
Fig. 2 (C) DATA SIGNAL FOR j TH COLUMN DATA ELECTRODE
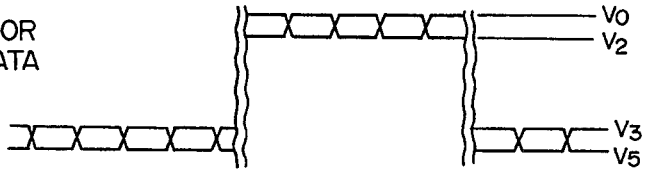
Fig. 2 (D) VOLTAGE APPLIED TO (i, j) TH DOT
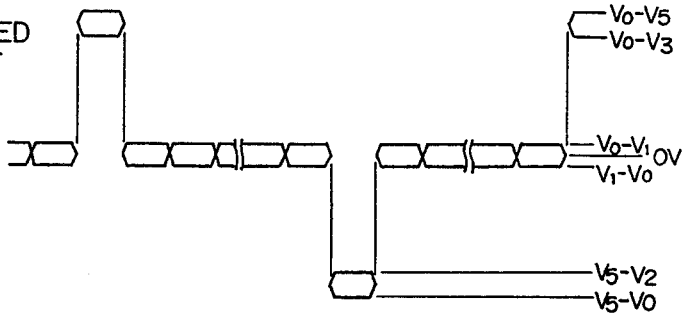

Fig. 3(A) LIQUID CRYSTAL ALTERNATING SIGNAL
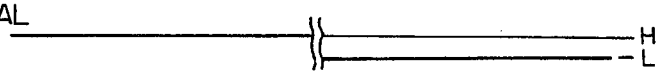
Fig. 3(B) DRIVING SIGNAL FOR iTH ROW COMMON ELECTRODE
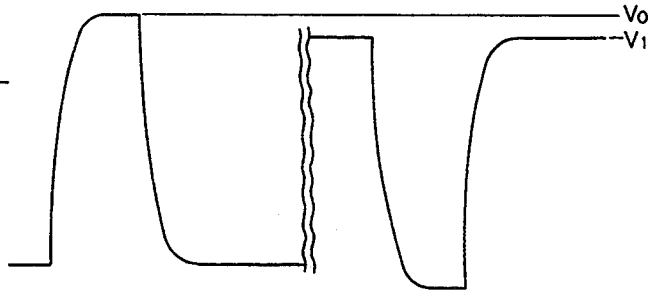
Fig. 3(C) DATA SIGNAL FOR DATA ELECTRODE
----- jTH COLUMN
—·— (j+1)TH COLUMN
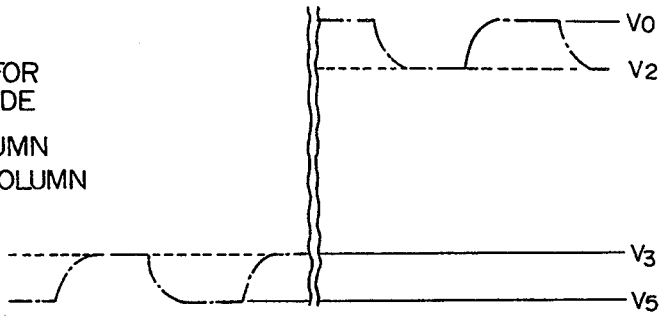
Fig. 3(D)
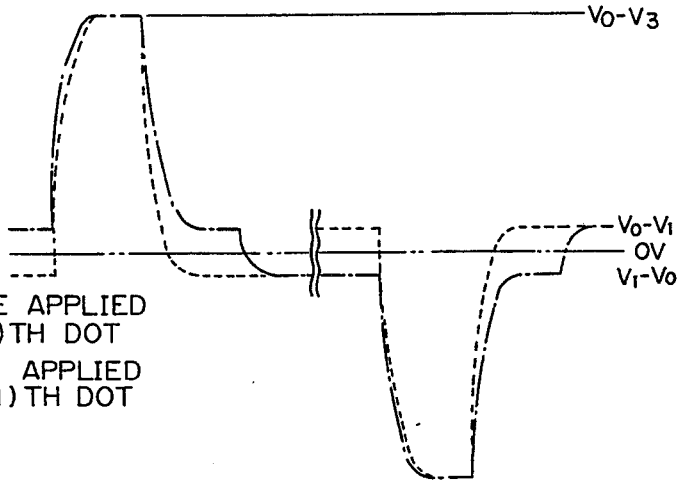
----- VOLTAGE APPLIED TO (i,j)TH DOT
—·— VOLTAGE APPLIED TO (i, j+1)TH DOT Fig. 4(A) LIQUID CRYSTAL ALTERNATING SIGNAL
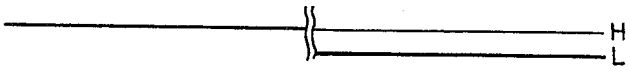
Fig. 4(B) DRIVING SIGNAL FOR iTH ROW COMMON ELECTRODE
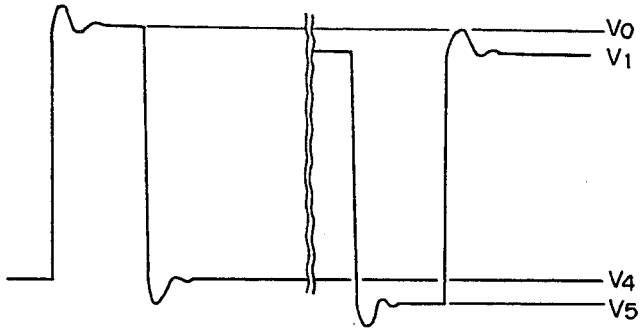
Fig. 4(C) DATA SIGNAL FOR DATA ELECTRODE
----- j TH COLUMN
—·— (j+1)TH COLUMN
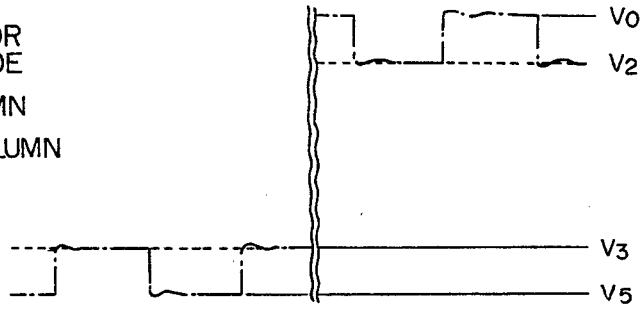
Fig. 4(D)
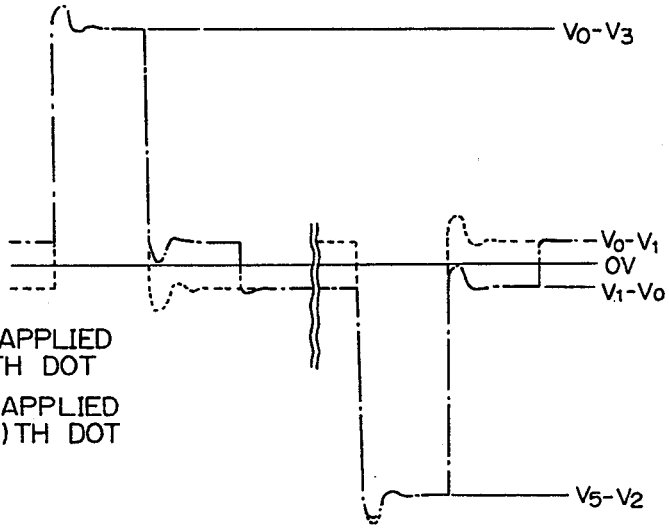
----- VOLTAGE APPLIED TO (i, j)TH DOT
—·— VOLTAGE APPLIED TO (i, j+1)TH DOT

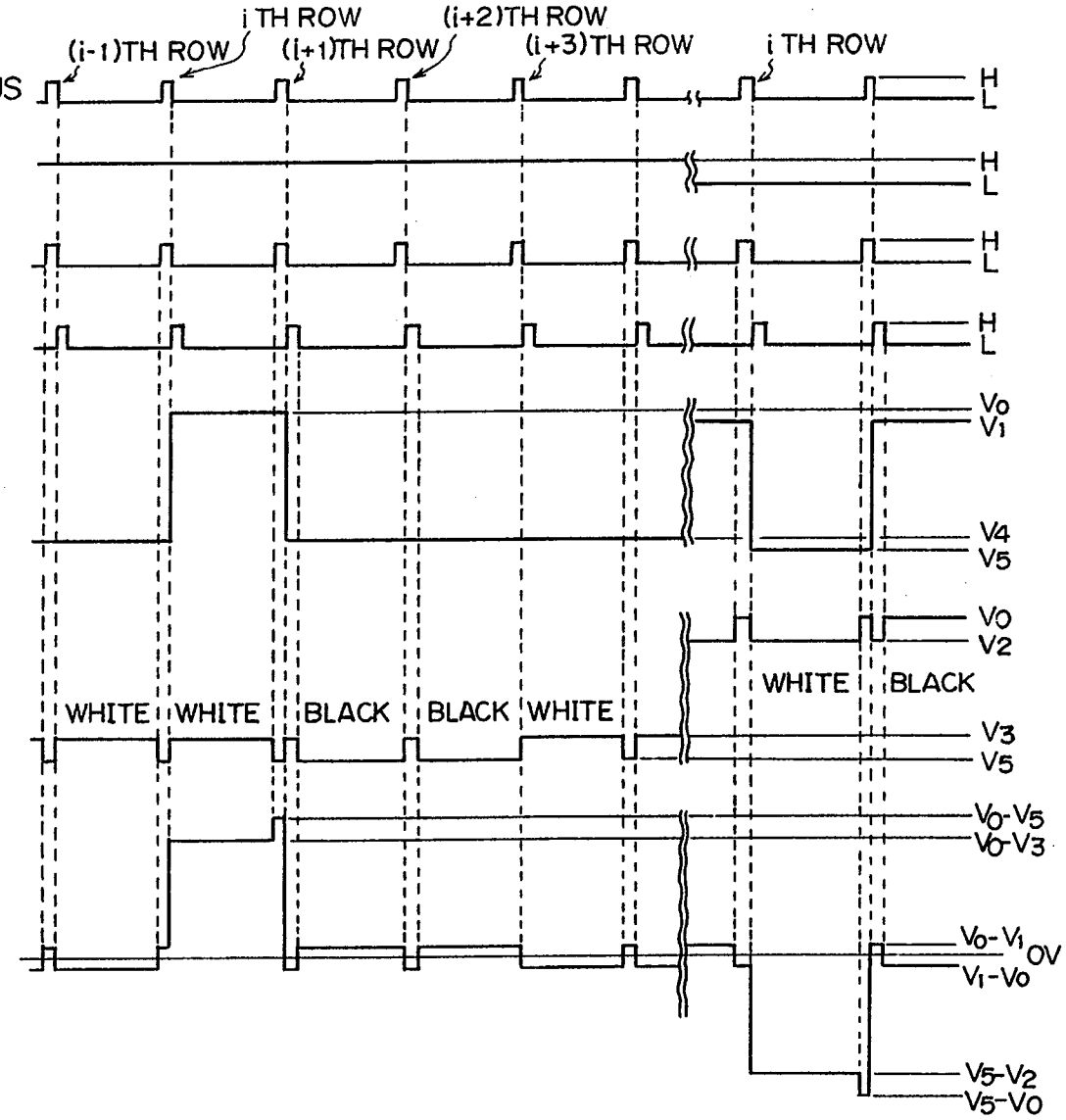
Fig. 7(A) HORIZONTAL SYNCHRONOUS SIGNAL
Fig. 7(B) LIQUID CRYSTAL ALTERNATING SIGNAL
Fig. 7(C) BLACK OFFSET SIGNAL
Fig. 7(D) WHITE OFFSET SIGNAL
Fig. 7(E) DRIVING SIGNAL FOR i TH ROW COMMON ELECTRODE
Fig. 7(F) DATA SIGNAL FOR j TH COLUMN DATA ELECTRODE
Fig. 7(G) VOLTAGE APPLIED TO (i,j) TH DOT Fig. 8(A) LIQUID CRYSTAL ALTERNATING SIGNAL
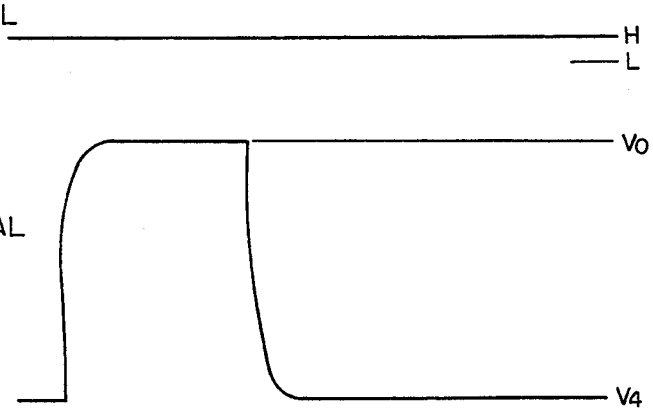
Fig. 8(B) DRIVING SIGNAL FOR iTH ROW COMMON ELECTRODE
Fig. 8(C) DATA SIGNAL FOR DATA ELECTRODE
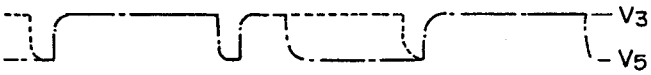
----- j TH COLUMN
—·— (j+1)TH COLUMN
Fig. 8(D)
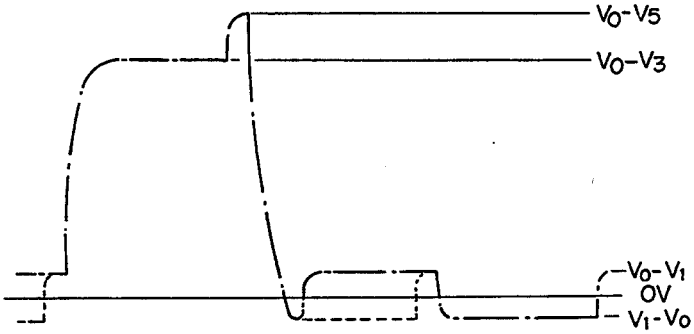
----- VOLTAGE APPLIED TO (i, j)TH DOT
—·— VOLTAGE APPLIED TO (i, j+1)TH DOT Fig. 9(A) LIQUID CRYSTAL ALTERNATING SIGNAL
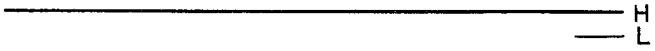
Fig. 9(B) DRIVING SIGNAL FOR iTH ROW COMMON ELECTRODE
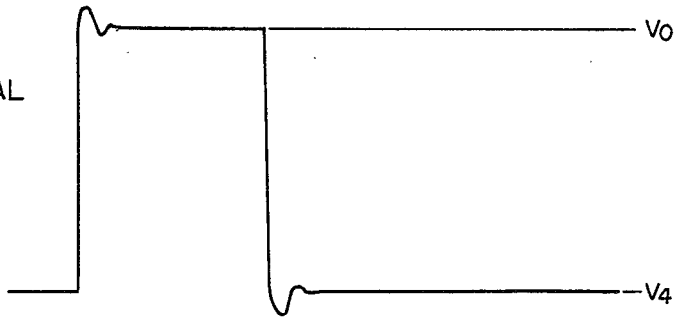
Fig. 9(C) DATA SIGNAL FOR DATA ELECTRODE
----- jTH COLUMN
—·— (j+1)TH COLUMN
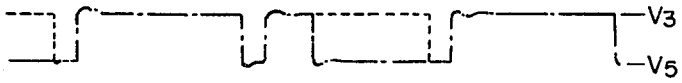
Fig. 9(D)
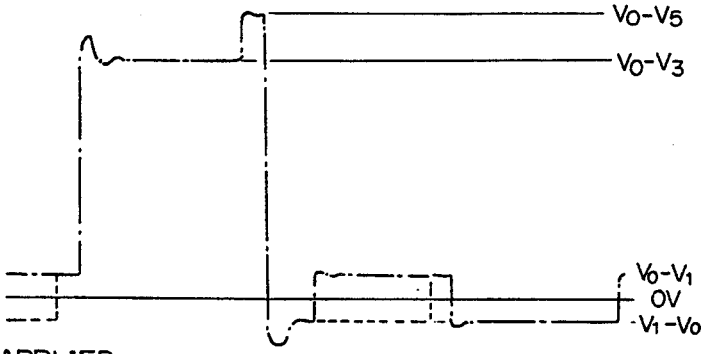
----- VOLTAGE APPLIED TO (i, j)TH DOT
—·— VOLTAGE APPLIED TO (i, j+1)TH DOT

DISPLAY CONTROL DEVICE WITH COMPENSATION FOR ROUNDED OR RINGING WAVEFORMS

This is a continuation of application Ser. No. 07/961,037, filed Oct. 14, 1992, now abandoned, which was a continuation of application Ser. No. 07/594,162, filed Oct. 9, 1990, now abandoned.

BACKGROUND OF THE INVENTION

1. Field of the Invention

The present invention relates to a display control device for a dot-matrix type liquid-crystal display device.

2. Description of the Related Art

A dot-matrix type liquid-crystal display device comprises a liquid-crystal panel, a common electrode driver for applying driving signals (scan pulses) to common electrodes, a data electrode driver for applying data signals to data electrodes, and a controller for controlling these drivers. Such a display device is driven by a so-called voltage averaging method. In this method, assuming that the dot matrix employed in the display device consists of m rows and n columns, a driving signal $i_\nu$ is applied to the ith row common electrode, a data signal $j_\nu$ is applied to the jth column data electrode, and a voltage corresponding to the difference $i_\nu - j_\nu$ between these signals is applied to a dot located on an intersection point of the ith row and the jth column.

If the signals $i_\nu$ and $j_\nu$ have ideal rectangular waveforms, no disadvantage occurs on the display. However, actual waveforms are subject to a rounding or ringing phenomenon, so that ghost or luminance unevenness occurs on the display as described in detail later.

SUMMARY OF THE INVENTION

It is therefore an object of the present invention to provide a display control device for a dot-matrix type liquid-crystal display device which is capable of displaying an image with neither ghost nor luminance unevenness even if the waveforms of signals to be applied to the common or data electrode are subjected to a rounding or ringing phenomenon.

The object of the invention can be achieved by a display control device for a dot-matrix type liquid-crystal display device having a plurality of common electrodes and data electrodes comprising;

first means for successively applying a scan pulse to said plurality of common electrodes; and second means for applying data signals each having black level or white level to said plurality of data electrodes, said second means being adapted to set each of said data signals to one of said black level or white level during a predetermined period of time immediately before the leading and trailing edges of said scan pulse and to the other of said black level or white level during a predetermined period of time immediately after the leading and trailing edges of said scan pulse.

With the display control device of the present invention, the voltages applied to dots which should exhibit the same luminance have the same effective value to provide a clear image with neither luminance unevenness nor ghost irrespective of waveforms of the data signals even if the data signals and the scan pulses are subjected to rounding or ringing.

Further objects and advantages of the present invention will be apparent from the following description of the preferred embodiments of the invention as illustrated in the accompanying drawings.

BRIEF DESCRIPTION OF THE DRAWINGS

FIGS. 2A to 2D are charts illustrating a liquid crystal alternating signal, a driving signal applied to the ith row common electrode, a data signal applied to the jth column data electrode and a voltage applied to the (i,j) dot, respectively;

FIGS. 3A to 3D are chart illustrating signals having rounded waveforms applied to the prior display control device;

FIGS. 4A to 4D are charts illustrating signals having ringing waveforms applied to the prior display control device;

FIG. 7A–7C are illustrating each timing of a horizontal synchronous signal, a liquid crystal alternating signal (a signal enabling the liquid crystal to be driven by alternating current), a black offset signal, a white offset signal, a driving signal applied to the ith row common electrode, a data signal applied to the jth column data electrode and a voltage applied to the (i,j) dot, which signals are related to the display control device of present invention;

FIGS. 8A to 8D are charts illustrating signals having rounded waveforms applied to the display control device according to the present invention; and FIGS. 9A to 9D are charts illustrating signals having ringing waveforms applied to the display control device according to the present invention.

DESCRIPTION OF THE PREFERRED EMBODIMENTS

Figure 1:
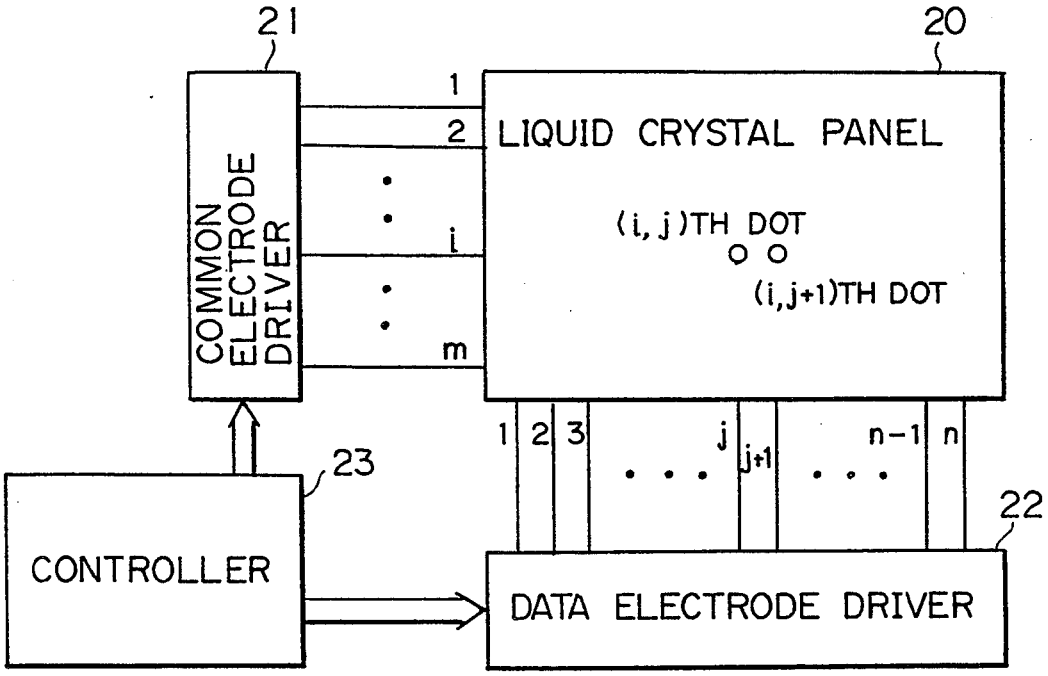
FIG. 1 is a block diagram showing a dot-matrix type liquid-crystal display device employing a prior display control device.

FIG. 1 illustrates an arrangement of a dot-matrix type liquid-crystal display device employing a prior display control device which is driven by the voltage averaging method. The liquid-crystal display device comprises a liquid-crystal panel 20 with a dot matrix consisting of m rows and n columns, a common electrode driver 21 for applying a driving signal (scan pulse) to each common electrode, a data electrode driver 22 for applying a data signal to each data electrode, and a controller 23 for controlling these drivers.

In the voltage averaging method, when a driving signal $i_\nu$ having a waveform shown in FIG. 2(B) is applied to the ith row common electrode and a data signal $j_\nu$ having a waveform shown in FIG. 2(C) is applied to the jth column data electrode, the difference $i_\nu - j_\nu$ between these signals, that is, the voltage having a waveform shown in FIG. 2(D) is applied to a dot located on an intersection point of the ith row and the jth column. This dot is referred to as "(i,j) dot" hereinafter. FIG. 2(A) illustrates a liquid crystal alternating signal used for reversing the signals $i_v$ and $j_v$ in order to drive the liquid crystal by alternating currents.

If the signals $i_v$ and $j_v$ have ideal rectangular waveforms no disadvantage occurs on the display. However, actual waveforms are subject to a rounding or ringing phenomenon, so that ghost or luminance unevenness occurs on the display.

First, a case in which the waveforms are subject to rounding will be explained with reference to FIG. 3.

FIG. 3(A) illustrates the liquid crystal alternating signal, FIG. 3(B) illustrates a rounded waveform of the driving signal $i_v$ applied to the ith row common electrode, and FIG. 3(C) illustrates a waveform of the data signal $j_v$ applied to the jth column data electrode by a broken line and a rounded waveform of the data signal $(j+1)_v$ applied to the (j+1)th column by a chained line. In this instance, white is displayed on all the dots located on the jth column and white and black are alternately displayed on all the dots located on the (j+1)th column. Since white is displayed on the (i,j) and the (i,j+1) dots, the voltages applied to these two dots have the same waveforms ideally. In actuality however, the rounded waveforms cause the difference $i_v-j_v$ applied to the (i,j) dot to have the waveform shown by the broken line of FIG. 3(D), and cause the difference $i_v-(j+1)_v$ applied to the (i,j+1) dot to have the waveform shown by the chained line of FIG. 3(D).

The luminance of each dot is determined by an effective value of each applied voltage. Assuming that T denotes a period of a voltage applied to the (i,j) dot, the luminance of the (i,j) dot is proportional to an effective value $e_{i,j}$ of the voltage represented by the following equation:

$$e_{i,j} = \left\{ \frac{1}{T} \int_O^T (iv - jv)^2 dt \right\}^{1/2}$$

Likewise, the luminance of the (i,j+1) dot is proportional to an effective value $e_{i,j+1}$ of the voltage represented by the following equation:

$$e_{i,j+1} = \left\{ \frac{1}{T} \int_O^T (iv - (j+1)v)^2 dt \right\}^{1/2}$$

As is apparent from the waveforms shown in FIG. 3(D), since $e_{i,j}$ is different from $e_{i,j+1}$, the two (i,j) and (i,j+1) dots exhibit different luminances though they both display white.

Next, another case in which waveforms are subjected to ringing will be explained with reference to FIG. 4.

FIG. 4(A) illustrates the liquid crystal alternating signal, FIG. 4(B) illustrates a waveform of the driving signal $i_v$ with ringing applied to the ith column common electrode, and FIG. 4(C) illustrates a waveform of the data signal $j_v$ applied to the jth column data electrode by a broken line and a waveform of the data signal $(j+1)_v$ with ringing applied to the (j+1)th column data electrode by a chained line. In this instance, white is displayed on all the dots located on the jth column, and white and black are alternately displayed on all the dots located on the (j+1)th column.

As described above, since white is displayed on the (i,j) and (i,j+1) dots, the voltages applied to these two dots have the same waveforms ideally. In actuality however, the waveforms having ringings causes the difference $i_v-j_v$ applied to the (i,j) dot to have the waveform shown by the broken line of FIG. 4(D) and the difference $i_v-(j+1)_v$ applied to the (i,j+1) dot to have the waveform shown by the chained line of FIG. 4(D).

Since $e_{i,j}$ is difference from $e_{i,j+1}$ in this case too, the two (i,j) and (i,J+1) dots exhibit different luminances though white is displayed on the two dots. This brings about ghost and luminance unevenness on the display.

Figure 5:
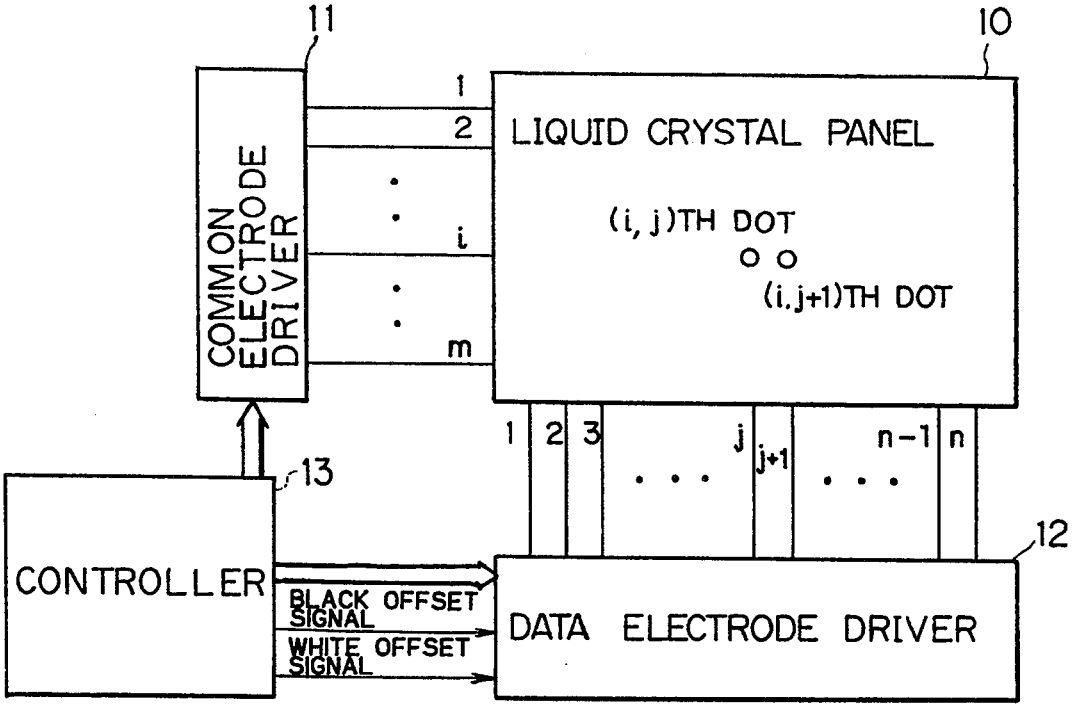
FIG. 5 is a block diagram showing a dot-matrix type liquid-crystal display device employing a display control device according to the present invention.

FIG. 5 illustrates an arrangement of a dot-matrix type liquid-crystal display device employing the display control device according to the present invention. In FIG. 5, 10 denotes a dot-matrix type liquid-crystal panel consisting of m rows and n columns, 11 denotes a common electrode driver for applying a driving signal (scan pulse) to each common electrode, 12 denotes a data electrode driver for applying a data signal to each data electrode, and 13 denotes a controller for controlling these drivers.

Like the foregoing prior display control device, the controller 13 sends out the horizontal synchronous signal to the common electrode driver 11 and the data signal to the data electrode driver 12. Further, it sends out a white offset signal and a black offset signal to the data electrode driver.

Figure 6A:
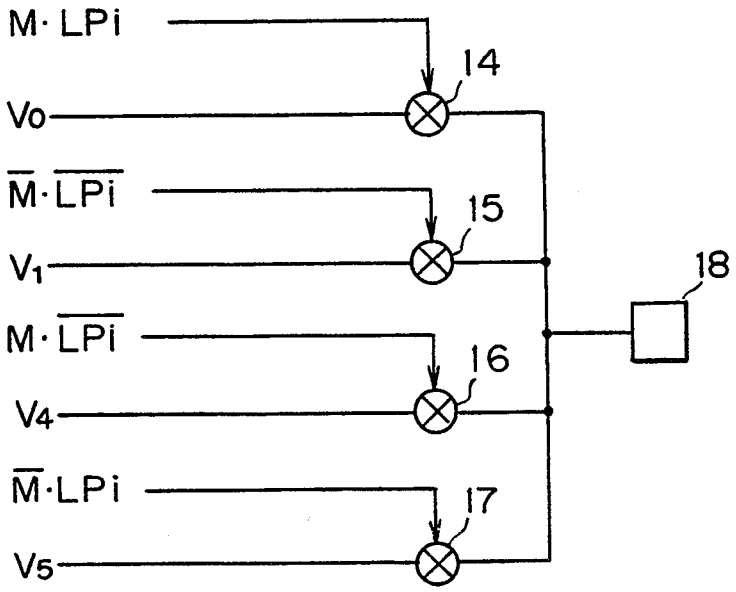
FIGS. 6A and 6B are circuit diagrams respectively showing a part of each internal circuit of the common electrode driver and the data electrode driver of the display control device according to the present invention.

FIG. 6A illustrates a part of an internal circuit of the common electrode driver 11 for sending the driving signal to the ith row common electrode. In FIG. 6A, 14 to 17 denote switches and 18 denotes the ith row common electrode connecting terminal. M denotes a logical signal indicative of a logical status of the liquid crystal alternating signal. When the liquid crystal alternating signal is at high level (H), M is "1". When it is at low level (L), $\overline{M}$ which is negation of M is "1". LPi denotes a logical signal which is set to "1" when the horizontal synchronous signal scans the ith row common electrode.

Figure 6B:
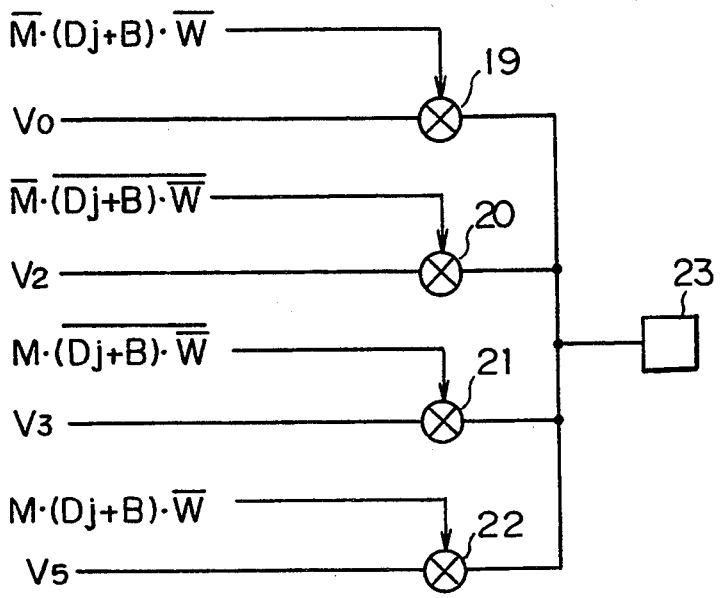

In FIG. 6A, assuming that the liquid crystal alternating signal is at high level (H) and the horizontal synchronous signal scans the ith row common electrode, a logical product M·LPi is "1", thereby causing the switch 14 to be conductive and the voltage V0 to be transmitted to the ith row common electrode. FIG. 6B illustrates a part of an internal circuit of the data electrode driver 12 for sending out the data signal to the jth column data electrode.

In FIG. 6B, 19 to 22 denote switches and 23 denotes the jth column data electrode connecting terminal. Dj denotes a signal indicative of a logical status of the data signal applied to the jth column data electrode. When the data signal is at high level (H) (corresponding to a black level, for example), the logical value of Dj is "1". While, when it is at low level (L) (corresponding to a white level, for example), the logical value of Dj is "0". B denotes a logical signal indicative of the level of the black offset signal. When the black offset signal is at high level (H), the signal B is "1" and when it is at low level (L), the signal B is "0". W denotes a logical signal indicative of the level of the white offset signal. When the white offset signal is at high level (H), the signal W is "1" and when it is at low level (L), the signal $\overline{W}$ which is negation of W is "1".

In FIG. 6B, assuming that the liquid crystal alternating signal M is at high level (H), the white offset signal is at low level (L) and any one of Dj and B is "1", the logical expression of $M\cdot(Dj+B)\cdot\overline{W}$ becomes "1", thereby causing the switch 22 to be conductive and the voltage V5 to be transmitted to the jth column data electrode. FIG. 7 illustrates each timing of these signals related to the foregoing circuits. As viewed vertically from FIG. 7(A) to (G), the illustrated waveforms are those of the horizontal synchronous signal, the liquid crystal alternating signal, the black offset signal, the white offset signal, the driving signal applied to the ith row common electrode, the driving signal applied to the jth column data electrode, and the voltage applied to the (i,j) dot. As illustrated in FIG. 7(A), (C), and (D), the trailing edge of the black offset signal is synchronous to that of the horizontal synchronous signal, and the leading edge of the white offset signal is synchronous to the trailing edge of the horizontal synchronous signal.

Then, a description will be directed to why no luminance uneveness is brought about even though the waveforms are rounded with reference to FIG. 8(A) to (D).

FIG. 8(A) illustrates the liquid crystal alternating signal, FIG. 8(B) illustrates a waveform of a rounded driving signal applied to the ith row common electrode. FIG. 8(C) illustrates a waveform of a data signal applied to the jth column data electrode by a broken line and a waveform of a data signal applied to the (j+1)th column data electrode by a chained line. The data signal illustrated by the broken line is such as to cause all the dots located on the jth column to display white. The data signal illustrated by the chained line is such as to cause all the dots located on the (j+1)th column to alternately display white and black in a manner to allow the (i,j+1) dot to display white. FIG. 8(D) illustrates a waveform of a voltage applied to the (i,j) dot by a broken line and a waveform of a voltage applied to the (i,j+1) dot by a chained line. According to the present embodiment, all the data signals are set to black level immediately before the leading edge of the horizontal synchronous signal by means of the black offset signal and are set to white level immediately after the trailing edge of the horizontal synchronous signal by means of the white offset signal. As shown in FIG. 8(D), therefore, the voltage applied to the (i,j) dot has the substantially same waveform and effective value as those of the voltage applied to the (i,j+1) dot. Unlike the prior display device, therefore, neither luminance unevenness nor ghost occurs on the display.

Next, the description will be directed to why no luminance unevenness is brought about even though the waveforms are subject to the ringing phenomenon with reference to FIG. 9(A) to (D).

FIG. 9(A) illustrates the liquid-crystal alternating signal. FIG. 9(B) illustrates a waveform of a driving signal subjected to ringing applied to the ith common electrode. FIG. 9(C) illustrates a waveform of a data signal applied to the jth column data electrode by a broken line and a waveform of a data signal applied to the (j+1)th column data electrode by a chained line. The data signal illustrated by the broken line is such as to cause all the dots located on the jth column to display white. The data signal illustrated by the chained line is such as to cause all the dots located on the (j+1)th column to alternately display white and black in a manner to allow the (i,j+1) dot to display white. FIG. 9(D) illustrates a waveform of a voltage applied to the (i,j) dot by a broken line and a waveform of a voltage applied to the (i,j+1) dot by a chained line.

In the present embodiment, all the data signals are set to black level immediately before the leading edge of the horizontal synchronous signal by means of the black offset signal, and set to white level immediately after the leading edge of the horizontal synchronous signal by means of the white offset signal. As illustrated in FIG. 9(D), the voltage applied to the (i,j) dot has the substantially same waveform and effective value as those of the voltage applied to the (i,j+1) dot even though the waveform is subject to the ringing phenomenon. Hence, unlike the foregoing prior display device, neither luminance unevenness nor ghost are brought about.

It goes without saying that the present invention is not limited to the foregoing embodiment. The embodiment is designed to offset the data signal to black level and then to white level. Conversely, by exchanging the signal B with signal W used in the circuit of FIG. 6B, it is possible to offset the data signal to white level and then to black level. Further, the display control device of the invention may apply to a multi-tone liquid-crystal display device employing a pulse width modulation system. Like the foregoing embodiment, in this case too, the voltages applied to the dots which should give the same luminance have the same effective value for providing a clear multi-tone image with neither luminance unevenness nor ghost.

What is claimed is:

1. A display control device for a dot-matrix type liquid-crystal display device having a plurality of parallel common electrodes and parallel data electrodes intersecting said common electrodes, comprising:

first means for successively applying scan pulses to said plurality of common electrodes, wherein the pulse width of each scan pulse corresponds to substantially one horizontal period; and second means for applying data signals, each having a first level voltage or a second level voltage, to said plurality of data electrodes, said second means further including level setting means to set each of said data signals to one of said first level voltage or second level voltage during a predetermined fixed period of time immediately before a leading or after a trailing edge of each of said scan pulses and to the other of said first level voltage or second level voltage during a predetermined fixed period of time immediately before the leading or after the trailing edge of each of said scan pulses, whereby noise is compensated irrespective of a pattern of an image to be displayed, so that a change between said first level voltage and said second level voltage occurs at least once during said predetermined fixed periods in one horizontal period regardless of voltages of said signals applied during periods other than said predetermined fixed periods to keep the number of times of level transitions in one horizontal period between said first level voltage and said second level voltage of data signals applied to each of said plurality of data electrodes substantially constant irrespective of the pattern of data signals of an image to be displayed.

2. A display control device according to claim 1, wherein said second means sets each of said data signals to said first level voltage during the predetermined period of time immediately before the leading or trailing edge of said scan pulse and to said second level voltage during the predetermined period of time immediately after the leading or trailing edges of said scan pulse.

3. A display control device according to claim 1, wherein said second means sets each of said data signals to said second level voltage during the predetermined period of time immediately before the leading or trailing edge of said scan pulse and to said first level voltage during the predetermined period of time immediately after the leading and trailing edges of said scan pulses.

4. A display control device according to claim 1, wherein said dot-matrix type liquid-crystal display device is driven by a voltage averaging method.

5. A display control device according to claim 1, wherein said dot-matrix type liquid-crystal display device is multi-tone display device.

6. A display control panel device for a dot-matrix type liquid-crystal display device having a plurality of common electrodes and data electrodes, comprising:

first means for successively applying a scan pulse to said plurality of common electrodes; and second means for applying data signals each having first level voltage or second level voltage to said plurality of data electrodes, said second means further including level setting means to always require a data signal having said second level voltage to temporarily assume said first level voltage in a predetermined fixed period at one of a beginning or ending of a corresponding horizontal synchronous period and to always require a data signal having said first level voltage to temporarily assume said second level voltage in a predetermined fixed period at the other of a beginning or an ending of a corresponding horizontal synchronous period, whereby noise is compensated irrespective of a pattern of an image to be displayed, so that a change between said first level voltage and said second level voltage occurs at least once during said predetermined fixed periods in one horizontal period regardless of voltages of said signals applied during periods other than said predetermined fixed periods to keep the number of times of level transitions in one horizontal period between said first level voltage and said second level voltage of data signals applied to each of said plurality of data electrodes substantially constant irrespective of the pattern of data signals of an image to be displayed.

7. A display device according to claim 6, further including means for generating a liquid crystal alternating signal, a black offset signal and a white offset signal, and wherein said second means includes analog switches for outputting different analog voltages, closure of each analog switch being controlled on the basis of the logical state of the liquid crystal alternating signal, the logical state of a logical sum of the applied data signal and the black offset signal, and the logical state of the white offset signal.

8. A display control device according to claim 1, wherein a dot corresponding to a dot cross point of a said common electrode and a data electrode becomes black when said scan pulse is applied to said common electrode and said first level voltage is applied to said data electrode during substantially one horizontal period.

9. A display control device according to claim 1, wherein a dot corresponding to a cross point of a said common electrode and a data electrode becomes white when said scan pulse is applied to said common electrode and said second level voltage is applied to said data electrode during substantially one horizontal period.

10. A display control device according to claim 1, further comprising means for generating a black offset pulse having a pulse width narrower than that of said scan pulse, a trailing edge of which is synchronous with the trailing edge of each of scan pulses.

11. A display control device according to claim 10, further comprising means for generating a white offset pulse having a pulse width narrower than that of said scan pulse, a leading edge of which is synchronous with the leading edge of each of scan pulses.

12. A display control device according to claim 11, wherein said first level voltage is outputted into said data electrode during a predetermined fixed period of time immediately before the leading or trailing edge of each of said scan pulses when the following logical expression has a logical state "1":

$$(D+B)\cdot\overline{W}$$

where D denotes a signal indicative of a logical status of the data signal applied to the data electrode, B denotes a logical signal indicative of the level of said black offset pulse, and W denotes a logical signal indicative of the level of the white offset pulse.

13. A display control device according to claim 12, wherein said second level voltage is outputted into said data electrode during a predetermined fixed period of time immediately after the leading or trailing edge of each of said scan pulses when the following logical expression has a logical state "1":

$$\overline{(D+B)\cdot W}$$

where D denotes a signal indicative of a logical status of the data signal applied to the data electrode, B denotes a logical signal indicative of the level of said black offset pulse, and W denotes a logical signal indicative of the level of the white offset pulse.

* * * * *